US008523309B2

(12) United States Patent
Ito

(10) Patent No.: US 8,523,309 B2
(45) Date of Patent: Sep. 3, 2013

(54) LIQUID DISCHARGER AND IMAGE FORMING APPARATUS HAVING THE SAME

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 195 days.

(21) Appl. No.: 13/246,249

(22) Filed: Sep. 27, 2011

(65) Prior Publication Data

US 2012/0075373 A1 Mar. 29, 2012

(30) Foreign Application Priority Data

Sep. 28, 2010 (JP) ..... 2010-216602

(51) Int. Cl.
*B41J 29/38* (2006.01)

(52) U.S. Cl.
USPC ..... 347/14

(58) Field of Classification Search
None
See application file for complete search history.

(56) References Cited

U.S. PATENT DOCUMENTS

| | | | | |
|---|---|---|---|---|
| 5,635,969 | A | 6/1997 | Allen | |
| 2003/0043230 | A1 * | 3/2003 | Koitabashi et al. | 347/37 |
| 2008/0136851 | A1 * | 6/2008 | Masuyama et al. | 347/8 |

FOREIGN PATENT DOCUMENTS

| | | | |
|---|---|---|---|
| JP | H07-195823 A | | 8/1995 |
| JP | 2002059559 A | * | 2/2002 |
| JP | 2008-168620 A | | 7/2008 |

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A liquid discharger is provided, which includes a gap adjustor that moves a first liquid discharge head between a first position and a second position where a gap between the first liquid discharge head and a sheet is smaller than when the first liquid discharge head is in the first position, and a controller configured to, when determining that second liquid is left enough to form an image and that a quality level stored in a storage unit is equal to or more than a predetermined level, control the gap adjustor to place the first liquid discharge head in the second position, control the first liquid discharge head to discharge the first liquid, and forbid a second liquid discharge head to discharge the second liquid.

15 Claims, 7 Drawing Sheets

Figure 1:
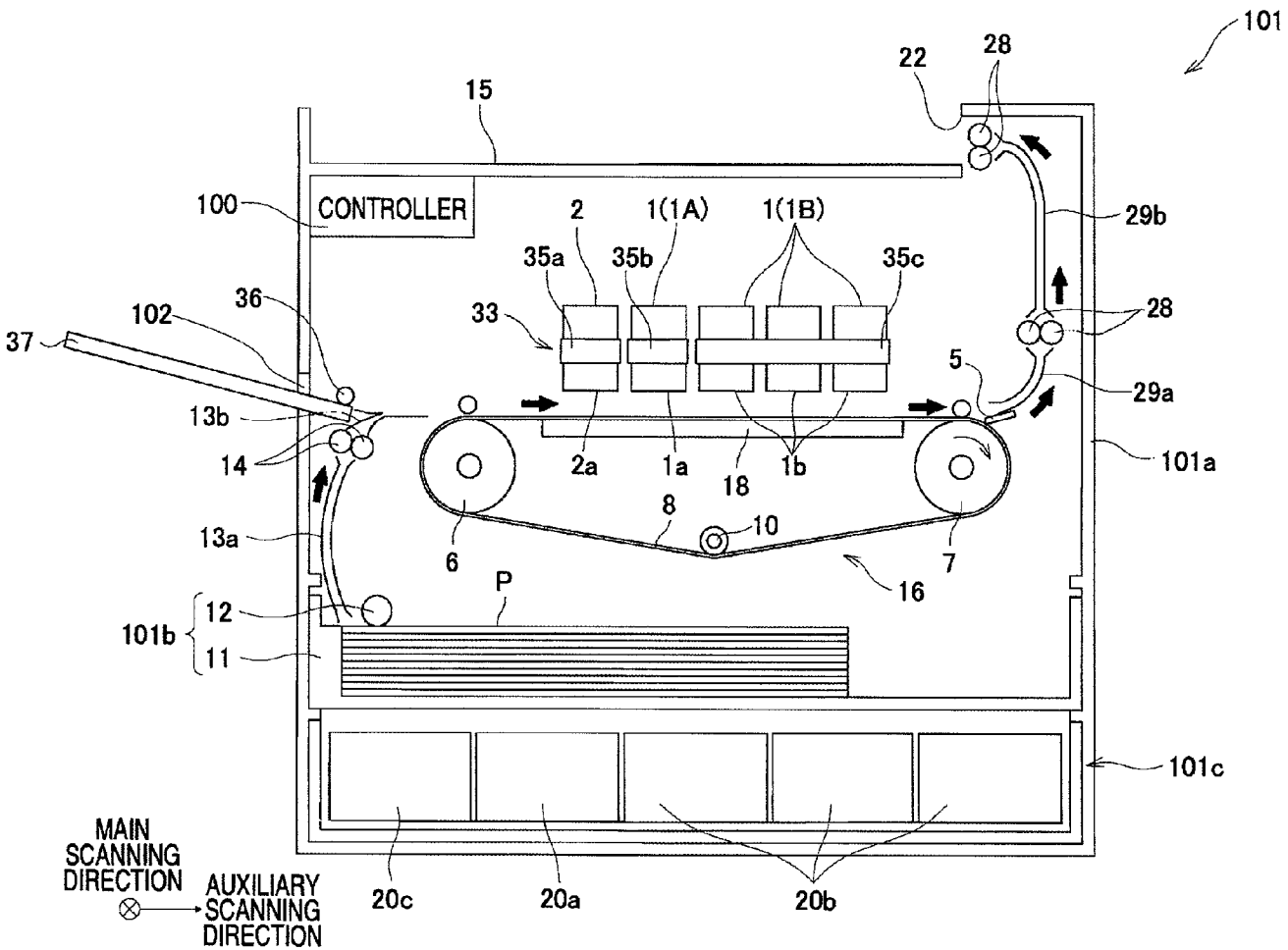

| LIQUID AMOUNT DETERMINING UNIT | PRINTING MODE DETERMINING UNIT | QUALITY LEVEL STORAGE UNIT | EXECUTION MODE DETERMINING UNIT |
|---|---|---|---|
| PRECOAT LIQUID WILL BE LEFT UNTIL COMPLETION OF PRINTING | MONOCHROME PRINTING MODE | HIGH IMAGE QUALITY LEVEL | 1st MODE |
| | | MIDDLE IMAGE QUALITY LEVEL or LOW IMAGE QUALITY LEVEL | |
| | COLOR PRINTING MODE | HIGH IMAGE QUALITY LEVEL | |
| | | MIDDLE IMAGE QUALITY LEVEL or LOW IMAGE QUALITY LEVEL | |
| THERE IS NOT ENOUGH PRECOAT LIQUID LEFT or PRECOAT LIQUID WILL BE EXHAUSTED IN MIDDLE OF PRINTING | MONOCHROME PRINTING MODE | HIGH IMAGE QUALITY LEVEL | 2nd MODE |
| | | MIDDLE IMAGE QUALITY LEVEL or LOW IMAGE QUALITY LEVEL | 3rd MODE |
| | COLOR PRINTING MODE | HIGH IMAGE QUALITY LEVEL | |
| | | MIDDLE IMAGE QUALITY LEVEL or LOW IMAGE QUALITY LEVEL | |

FIG. 4

LIQUID DISCHARGER AND IMAGE FORMING APPARATUS HAVING THE SAME

CROSS-REFERENCE TO RELATED APPLICATION

This application claims priority under 35 U.S.C. §119 from Japanese Patent Application No. 2010-216602 filed on Sep. 28, 2010. The entire subject matter of the application is incorporated herein by reference.

BACKGROUND

1. Technical Field

The following description relates to one or more techniques adapted to, prior to discharging first liquid for image formation, discharge onto a recording medium second liquid for agglutinating or precipitating one or more components contained in the first liquid.

2. Related Art

As an example of techniques to decrease a degree of ink bleeding on an image formed on a sheet (a recording medium), the following technique has been known.

According to the known technique, before an ink discharge head discharges an ink droplet into each point on the sheet where the image is to be formed, a preprocessing liquid discharge head discharges, into the point, preprocessing liquid for agglutinating the ink droplet. Thereby, the ink droplet is agglutinated by the preprocessing liquid immediately after being discharged onto the sheet, it results in a decreased degree of ink bleeding.

SUMMARY

However, in the situation where there is no or little preprocessing liquid left, when image formation on the sheet is continuously performed with discharge of only ink droplets, it might lead to a problem that it is impossible to form the image with a required level of image quality since it is impossible to use the preprocessing liquid.

Aspects of the present invention are advantageous to provide one or more improved techniques for a liquid discharger that make it possible to prevent image quality of an image formed on a sheet from being deteriorated and to maintain a desired level of image quality.

According to aspects of the present invention, a liquid discharger is provided, which includes a feeding mechanism configured to feed a sheet in a predetermined feeding direction, a first liquid tank configured to store first liquid for forming an image on the sheet, a first liquid discharge head including a first discharge hole formed to discharge the first liquid stored in the first liquid tank, a second liquid tank configured to store second liquid that acts on the first liquid so as to agglutinate or precipitate a component contained in the first liquid, a second liquid discharge head including a second discharge hole formed to discharge the second liquid stored in the second liquid tank, the second liquid discharge head being disposed upstream relative to the first liquid discharge head in the predetermined feeding direction, a remaining second-liquid amount detector configured to detect a remaining amount of the second liquid stored in the second liquid tank, a gap adjustor configured to adjust a gap between the first discharge hole of the first liquid discharge head and the sheet facing the first discharge hole, by moving the first liquid discharge head between a first position and a second position where the gap is smaller than when the first liquid discharge head is in the first position, a storage unit configured to store one of a plurality of quality levels regarding image quality of the image to be formed on the sheet, and a controller configured to control the first liquid discharge head, the second liquid discharge head, the feeding mechanism, and the gap adjustor so as to form the image on the sheet based on image data. The controller is configured to carry out a plurality of execution modes including a first mode and a second mode. In the first mode, the controller controls the gap adjustor to place the first liquid discharge head in the first position, controls the first liquid discharge head to discharge the first liquid from the first discharge hole, and controls the second liquid discharge head to discharge the second liquid from the second discharge hole. In the second mode, the controller controls the gap adjustor to place the first liquid discharge head in the second position, controls the first liquid discharge head to discharge the first liquid from the first discharge hole, and forbids the second liquid discharge head to discharge the second liquid from the second discharge hole. When determining that the second liquid stored in the second liquid tank is left enough to form the image based on the remaining amount of the second liquid detected by the remaining second-liquid amount detector, the controller carries out the first mode. When determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

According to aspects of the present invention, further provided is an image forming apparatus that includes a feeding mechanism configured to feed a sheet in a predetermined feeding direction, a liquid discharger configured to discharge a plurality of sorts of liquid onto the sheet fed by the feeding mechanism to form an image on the sheet, a controller configured to control the feeding mechanism and the liquid discharger to form the image on the sheet based on image data. The liquid discharger includes a first liquid tank configured to store first liquid for forming the image on the sheet, a first liquid discharge head including a first discharge hole formed to discharge the first liquid stored in the first liquid tank, a second liquid tank configured to store second liquid that acts on the first liquid so as to agglutinate or precipitate a component contained in the first liquid, a second liquid discharge head including a second discharge hole formed to discharge the second liquid stored in the second liquid tank, the second liquid discharge head being disposed upstream relative to the first liquid discharge head in the predetermined feeding direction, a remaining second-liquid amount detector configured to detect a remaining amount of the second liquid stored in the second liquid tank, a gap adjustor configured to adjust a gap between the first discharge hole of the first liquid discharge head and the sheet facing the first discharge hole, by moving the first liquid discharge head between a first position and a second position where the gap is smaller than when the first liquid discharge head is in the first position, and a storage unit configured to store one of a plurality of quality levels regarding image quality of the image to be formed on the sheet. The controller is configured to carry out a plurality of execution modes including a first mode and a second mode. In the first mode, the controller controls the gap adjustor to place the first liquid discharge head in the first position, controls the first liquid discharge head to discharge the first liquid from the first discharge hole, and controls the second liquid discharge head to discharge the second liquid from the second discharge hole. In the second mode, the controller controls the gap adjustor to place the first liquid discharge head in the second position, controls the first liquid discharge head to discharge the first liquid from the first discharge hole, and forbids the second liquid discharge head to discharge the second liquid from the second discharge hole. When determining that the second liquid stored in the second liquid tank is left enough to form the image based on the remaining amount of the second liquid detected by the remaining second-liquid amount detector, the controller carries out the first mode. When determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

According to aspects of the present invention, further provided is an image forming apparatus that includes a feeding mechanism configured to feed a sheet in a predetermined feeding direction, a liquid discharger configured to discharge a plurality of sorts of liquid onto the sheet fed by the feeding mechanism to form an image on the sheet, a controller configured to control the feeding mechanism and the liquid discharger to form the image on the sheet based on image data. The liquid discharger includes a first liquid tank unit configured to store a plurality of sorts of first liquid for forming the image on the sheet, the plurality of sorts of first liquid including black liquid and color liquid, a first liquid discharge head that includes a black liquid discharge head including a black discharge hole formed to discharge the black liquid stored in the first liquid tank unit and a color liquid discharge head including a color discharge hole formed to discharge the color liquid stored in the first liquid tank unit, the color liquid discharge head being disposed downstream relative to the black liquid discharge head in the predetermined feeding direction, a second liquid tank configured to store second liquid that acts on the first liquid so as to agglutinate or precipitate a component contained in the first liquid, a second liquid discharge head including a second discharge hole formed to discharge the second liquid stored in the second liquid tank, the second liquid discharge head being disposed upstream relative to the first liquid discharge head in the predetermined feeding direction, a remaining second-liquid amount detector configured to detect a remaining amount of the second liquid stored in the second liquid tank, a gap adjustor configured to adjust a gap between the black discharge hole of the black liquid discharge head and the sheet by moving the black liquid discharge head between a first position and a second position where the gap is smaller than when the black liquid discharge head is in the first position, and a storage unit configured to store one of a plurality of quality levels regarding image quality of the image to be formed on the sheet. The controller is configured to carry out a plurality of execution modes including a first mode, a second mode, and a third mode. In the first mode, the controller controls the gap adjustor to place the black liquid discharge head in the first position, controls the first liquid discharge head to discharge at least the black liquid from the black discharge hole, and controls the second liquid discharge head to discharge the second liquid from the second discharge hole. In the second mode, the controller controls the gap adjustor to place the black liquid discharge head in the second position, controls the black liquid discharge head to discharge the black liquid from the black discharge hole, forbids the color liquid discharge head to discharge the color liquid from the color discharge hole, and forbids the second liquid discharge head to discharge the second liquid from the second discharge hole. In the third mode, the controller controls the gap adjustor to place the black liquid discharge head in the first position, controls the first liquid discharge head to discharge at least the black liquid from the black discharge hole, and forbids the second liquid discharge head to discharge the second liquid from the second discharge hole. When determining that the second liquid stored in the second liquid tank is left enough to form the image based on the remaining amount of the second liquid detected by the remaining second-liquid amount detector, the controller carries out the first mode. When determining that the second liquid stored in the second liquid tank is not left enough to form the image based on the remaining amount of the second liquid detected by the remaining second-liquid amount detector, that monochrome printing is to be carried out, and that the quality level stored in the storage unit is equal to or more than a predetermined level, the controller carries out the second mode. When determining that the second liquid stored in the second liquid tank is not left enough to form the image based on the remaining amount of the second liquid detected by the remaining second-liquid amount detector and that the quality level stored in the storage unit is less than the predetermined level, the controller carries out the third mode.

According to aspects of the present invention, further provided is a liquid discharger, which includes a feeding mechanism configured to feed a sheet in a predetermined feeding direction, a first liquid tank configured to store first liquid for forming an image on the sheet, a first-liquid discharge head including a first discharge hole formed to discharge the first liquid stored in the first liquid tank, a second liquid tank configured to store second liquid that acts on the first liquid so as to agglutinate or precipitate a component contained in the first liquid, a second-liquid applicator configured to apply the second liquid stored in the second liquid tank onto the sheet fed by the feeding mechanism prior to the first liquid being discharged onto the sheet by the first-liquid discharge head, a remaining second-liquid amount detector configured to detect a remaining amount of the second liquid stored in the second liquid tank, a gap adjustor configured to adjust a gap between the first discharge hole of the first-liquid discharge head and the sheet facing the first discharge hole, by moving the first-liquid discharge head between a first position and a second position where the gap is smaller than when the first-liquid discharge head is in the first position, a storage unit configured to store one of a plurality of quality levels regarding image quality of the image to be formed on the sheet, and a controller configured to control the first-liquid discharge head, the second-liquid applicator, the feeding mechanism, and the gap adjustor so as to form the image on the sheet based on image data. The controller is configured to carry out a plurality of execution modes including a first mode and a second mode. In the first mode, the controller controls the gap adjustor to place the first-liquid discharge head in the first position, controls the first-liquid discharge head to discharge the first liquid from the first discharge hole, and controls the second-liquid applicator to apply the second liquid onto the sheet. In the second mode, the controller controls the gap adjustor to place the first-liquid discharge head in the second position, controls the first-liquid discharge head to discharge the first liquid from the first discharge hole, and forbids the second-liquid applicator to apply the second liquid onto the sheet. When determining that the second liquid stored in the second liquid tank is left enough to form the image based on the remaining amount of the second liquid detected by the remaining second-liquid amount detector, the controller carries out the first mode. When determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

BRIEF DESCRIPTION OF THE ACCOMPANYING DRAWINGS

FIG. 1 is a side view schematically showing an overall configuration of an inkjet printer in an embodiment according to one or more aspects of the present invention.

Figure 2A:
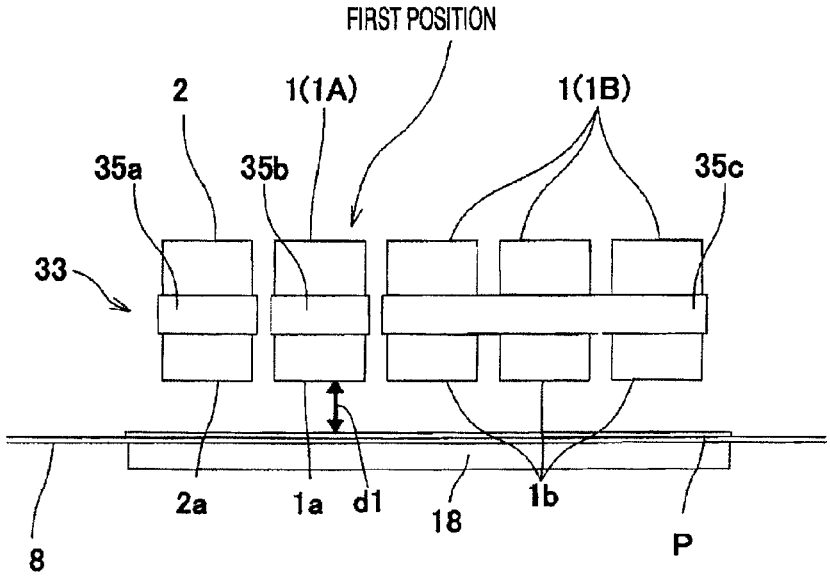
Figure 2B:
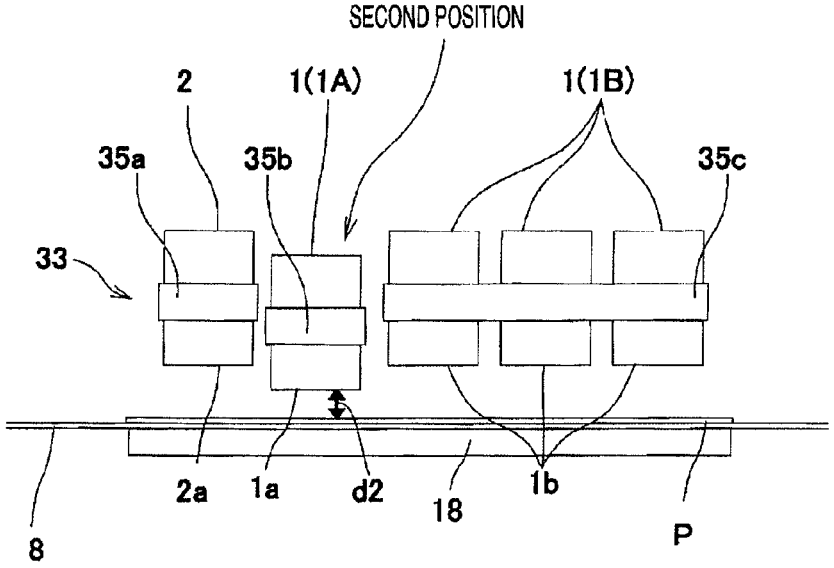

FIGS. 2A and 2B schematically show two states where an inkjet head is positioned relative to a sheet with respective different gaps between a discharge surface of the inkjet head and the sheet in the embodiment according to one or more aspects of the present invention.

Figure 3:
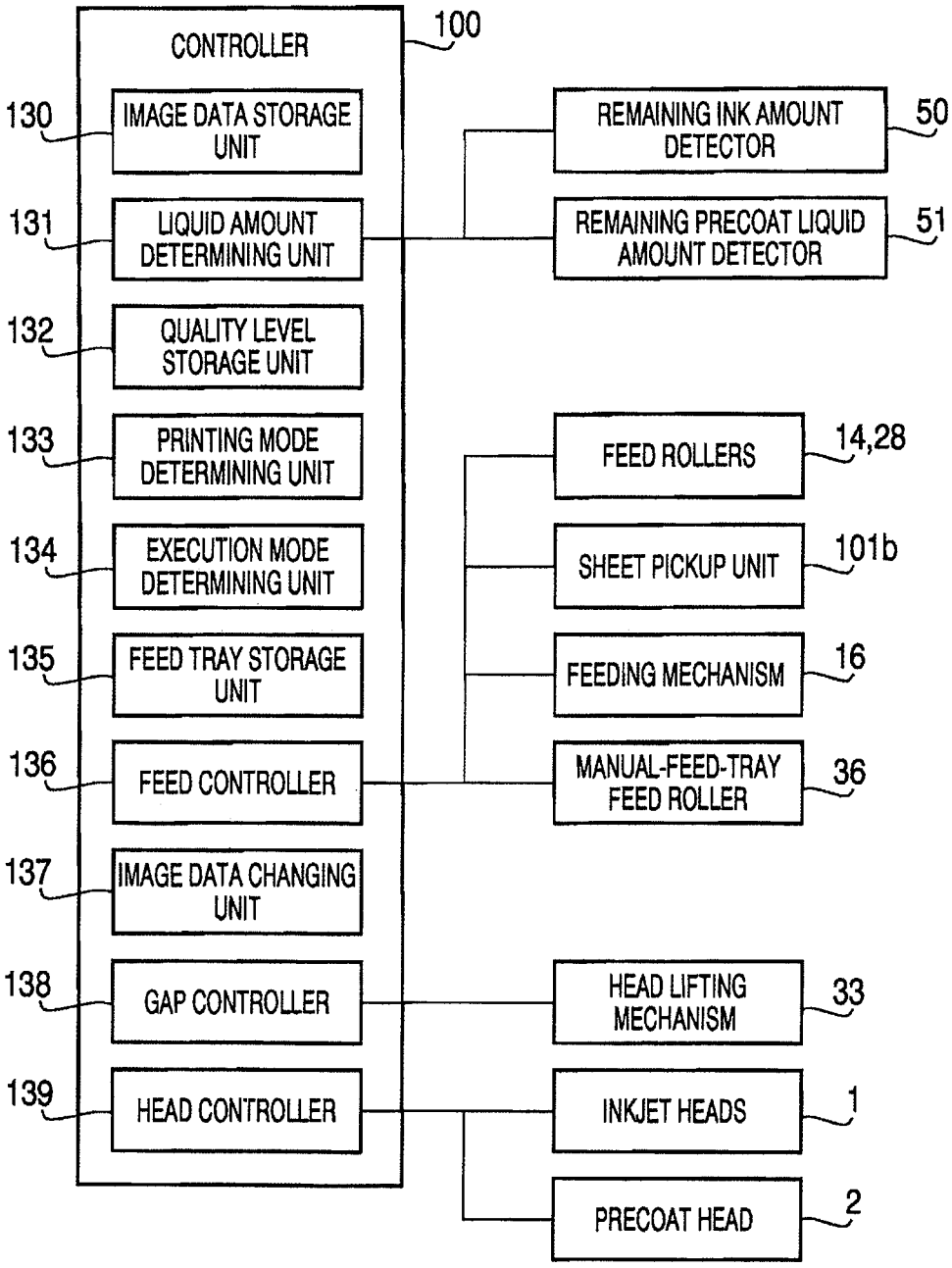

FIG. 3 is a block diagram schematically showing a configuration of a controller of the inkjet printer in the embodiment according to one or more aspects of the present invention.

FIG. 4 exemplifies a correspondence relationship among determination results by a liquid amount determining unit, determination results by a printing mode determining unit, quality levels stored in a quality level storage unit, and execution modes determined by an execution mode determining unit in the embodiment according to one or more aspects of the present invention.

Figure 5:
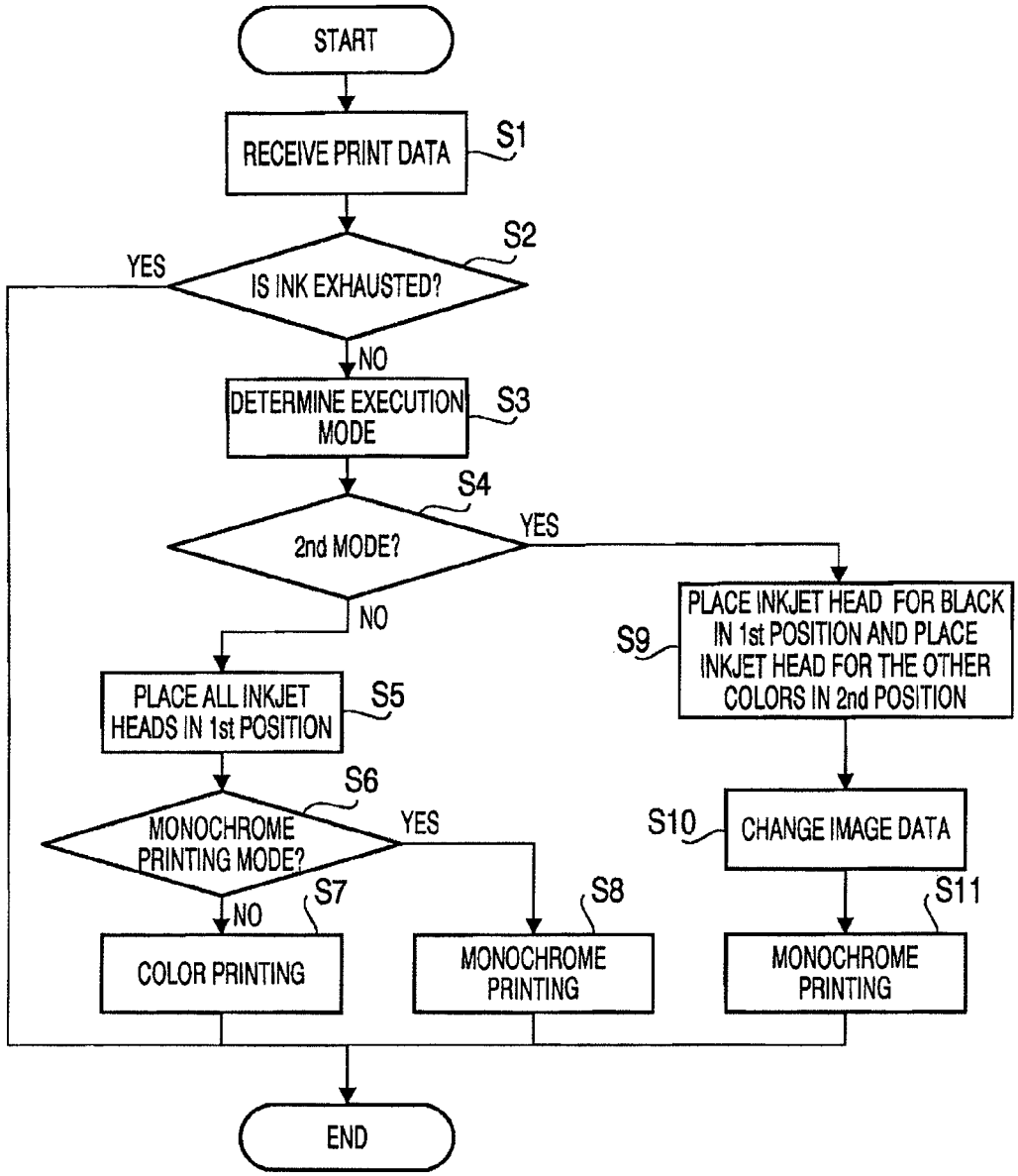

FIG. 5 is a flowchart showing a procedure of a printing operation by the controller of the inkjet printer in the embodiment according to one or more aspects of the present invention.

Figure 6:
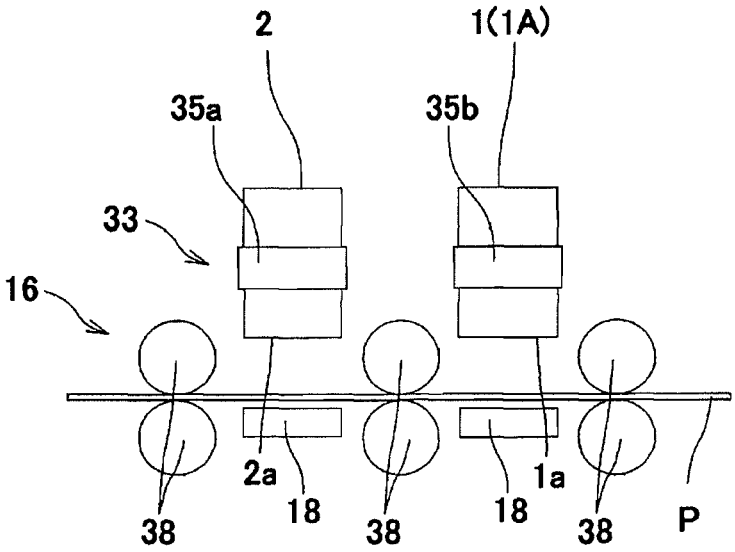

FIG. 6 schematically shows a configuration of a feeding mechanism in a modification according to one or more aspects of the present invention.

Figure 7:
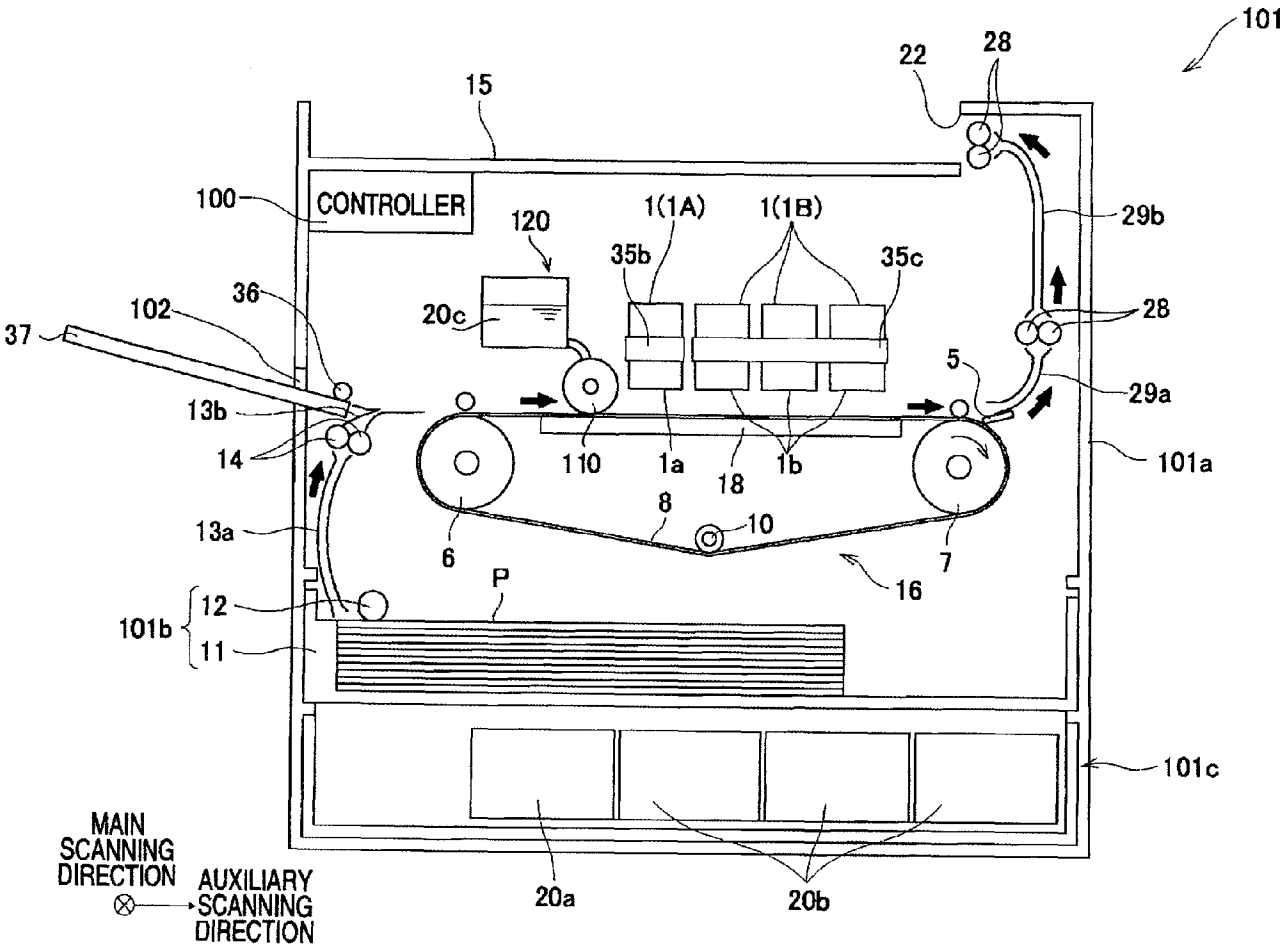

FIG. 7 is a side view schematically showing an overall configuration of an inkjet printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompanying drawings.

As shown in FIG. 1, an inkjet-printer 101 of the embodiment has a housing 101*a* formed substantially in a rectangular parallelepiped shape. The inkjet printer 101 includes, in the housing 101*a*, a feeding mechanism 16 configured to feed a sheet (a recording medium) P in feeding direction (a direction heading to a right side from a left side in FIG. 1), four inkjet heads 1 (1A and 1B) configured to discharge onto the sheet P ink droplets of black (K), cyan (C), magenta (M), and yellow (Y), respectively, a precoat head 2 configured to discharge droplets of precoat liquid for agglutinating or precipitating a coloring component of each color of ink, a head lifting mechanism 33, and a controller 100 configured to take overall control of the inkjet printer 101.

It is noted that in the following description, an auxiliary scanning direction will be defined as a direction parallel to the feeding direction in which the feeding mechanism 16 feeds the sheet P. Further, a main scanning direction will be defined as a direction perpendicular to the auxiliary scanning direction and parallel to a horizontal plane.

The inkjet printer 101 further includes a tank unit 101*c* provided in the housing 101*a*. The tank unit 101*c* includes therein an ink tank 20*a* configured to accommodate black ink, three ink tanks 20*b* configured to accommodate magenta ink, cyan ink, and yellow ink, respectively, and a precoat liquid tank 20*c* configured to accommodate the precoat liquid. The ink tanks 20*a* and 20*b*, and the precoat liquid tank 20*c* are detachably attached to the tank unit 101*c*.

Each color of ink stored in the ink tanks 20*a* and 20*b* is supplied, via an ink tube (not shown), to a corresponding one of the inkjet heads 1A and 1B. In the same manner, the precoat liquid stored in the precoat liquid tank 20*c* is supplied to the precoat head 2 via a precoat tube (not shown). The tank unit 101*c* is provided with a remaining ink amount detector 50 (see FIG. 3) for each tank, which is configured to detect a remaining amount of the ink stored in each of the ink tanks 20*a* and 20*b*. In the same manner, the tank unit 101*c* is provided with a remaining precoat liquid amount detector 51 (see FIG. 3) configured to detect a remaining amount of the precoat liquid stored in the precoat liquid tank 20*c*.

As the processing liquid, in general, precoat liquid for agglutinating a pigment coloring component is applied to pigment ink, and precoat liquid for precipitating a dye coloring component is applied to dye ink. As material for the precoat liquid, for instance, liquid containing polyvalent metal salt such as cationic polymer and magnesium salt may be selected as needed. When the ink is discharged into an area on the sheet P where the precoat liquid has previously been applied, the polyvalent metal salt acts on the coloring component (pigment or dye) of the ink such that insoluble or hardly-soluble metallic complex is formed with the coloring component being agglutinated or precipitated. It results in a reduced degree of penetration of the ink into the sheet P. In addition, the precoat liquid may have a function to enhance a color optical density of the ink.

Further, the inkjet printer 101 includes, along a feeding path for the sheet P, a sheet pickup unit 101*b*, the feeding mechanism 16 disposed above the sheet pickup unit 101*b*, and a catch tray 15 configured such that the sheet P is ejected thereto. Furthermore, the inkjet printer 101 includes a manual feed tray 37 that protrudes slightly obliquely toward an upper left side from a left side surface of the housing 101*a* in FIG. 1. The manual sheet feed tray 37 is detachably attached to the housing 101*a* via an opening 102.

The sheet pickup unit 101*b* is detachably attached to the housing 101*a* and provided with a feed tray 11 and a pickup roller 12. The feed tray 11 is formed in an upward-opening box shape and housed with a stack of sheets P placed therein. The pickup roller 12 is controlled by the controller 100 to feed a top one of the sheets P placed in the feed tray 11 toward the feeding mechanism 16. The fed sheet P is conveyed by feed rollers 14, along guides 13*a* and 13*b* toward the feeding mechanism 16. In the embodiment, regular papers are placed in the feed tray 11.

Near an end of the manual feed tray 37 that is inserted into the housing 101*a*, there is disposed a manual-feed-tray feed roller 36 configured to feed to the feeding mechanism 16 sheets P placed on the manual feed tray 37. The manual-feed-tray feed roller 36 is controlled by the controller 100 to feed a top one of the sheets P placed on the manual feed tray 37. In the embodiment, thick papers such as post cards or envelopes are placed on the manual feed tray 37.

The feeding mechanism 16 includes two belt rollers 6 and 7, a conveying belt 8, a tension roller 10, and a platen 18. The conveying belt 8 is an endless belt wound around the two belt rollers 6 and 7 and provided with a tension applied by the tension roller 10. The belt roller 7 is a driving roller that is driven by a motor (not shown) to rotate in a clockwise direction in FIG. 1 and makes the conveying belt 8 travel. The belt roller 6 is a driven roller rotated by traveling of the conveying belt 8. On an outer circumferential surface of the conveying belt 8, a weakly-adhesive silicon layer is formed to hold the sheet P placed thereon. The sheet P placed on the outer circumferential surface of the conveying belt 8 is conveyed rightward in FIG. 1.

On a downstream side of the feeding mechanism 16 in the feeding direction, a separation plate 5 is disposed. The sheet P, conveyed in the feeding direction by the feeding mechanism 16, sequentially passes under the four inkjet heads 1A and 1B, and thereafter is separated from a conveying surface of the conveying belt 8 by the separation plate 5. The sheet P separated by the separation plate 5 is conveyed upward along guides 29*a* and 29*b* by two pairs of feed rollers 28 and ejected onto the catch tray 15 via an ejection port 22 formed at an upper side of the housing 101*a*. The platen 18 is disposed to face the four inkjet heads 1A and 1B and the precoat head 2 across the conveying belt 8, so as to support an upper side of the loop of the conveying belt 8 from the inside of the conveying belt 8.

The four inkjet heads 1A and 1B and the precoat head 2 are configured in the same manner to extend along the main scanning direction, and disposed at intervals of a predetermined distance to be parallel to each other in the auxiliary scanning direction. Lower surfaces of the inkjet heads 1A and 1B include respective discharge surfaces 1*a* and 1*b* each of which is formed with a plurality of discharge holes arranged along the main scanning direction at intervals conforming to a dot density of 600 dpi. Namely, the inkjet printer 101 is a line-type inkjet printer with a plurality of discharge holes for discharging ink droplets arranged along the main scanning direction. Further, in the same manner, a lower surface of the precoat head 2 is a discharge surface 2*a* formed with a plurality of discharge holes arranged along the main scanning direction at intervals conforming to a dot density of 600 dpi.

The inkjet head 1A, disposed upstream relative to the other three inkjet heads 1B in the feeding direction, discharges an ink droplet of black. The other three inkjet heads 1B discharge ink droplets of colors other than black, i.e., magenta, cyan, and yellow, respectively. Further, the precoat head 2 for discharging droplets of the precoat liquid is disposed upstream relative to the four inkjet heads 1A and 1B in the feeding direction.

The outer circumferential surface of the upper side of the loop of the conveying belt 8 faces the discharge surfaces 1*a*, 1*b*, and 2*a*, so as to be parallel to the discharge surfaces 1*a*, 1*b*, and 2*a*. When passing just beneath the precoat head 2, the sheet P conveyed by the conveying belt 8 is supplied with droplets of the precoat liquid discharged by the precoat head 2, such that the precoat liquid is applied to areas on an up-facing side of the sheet P where an image is to be formed. After that, when passing just beneath the four inkjet heads 1A and 1B, the sheet P is supplied with ink droplets of each color that are discharged sequentially by the inkjet heads 1A and 1B onto the areas on the up-facing side of the sheet P where the precoat liquid has been applied. Thereby, a desired monochrome image or a desired color image is formed on the sheet P. At this time, when an ink droplet lands on the precoat liquid applied onto the sheet P, the precoat liquid agglutinates or precipitates the coloring component contained in the ink droplet. Thus, it is possible to prevent bleeding of the ink on the sheet P.

The head lifting mechanism 33 includes frames 35*a*, 35*b*, and 35*c* that support the inkjet heads 1A and 1B and the precoat head 2, respectively, and a lifting device (not shown) configured to individually move up and down the frames 35*a*, 35*b*, and 35*c*. It is noted that as the lifting device, a rack-and-pinion or a solenoid may be employed.

As illustrated in FIG. 1, the precoat head 2 is fixed to the frame 35*a*. The inkjet head 1A for discharging ink droplets of black is fixed to the frame 35*b*. The inkjet heads 1B for discharging ink droplets of magenta, cyan, and yellow are fixed to the frame 32*c*.

The head lifting mechanism 33 can move up and down the frames 35*a*, 35*b*, and 35*c* to move up and down the four inkjet heads 1 and the precoat head 2. Thereby, the head lifting mechanism 33 can form a predetermined distance of gap that is suitable for forming the image depending on the thickness of the sheet P, between the sheet P placed on the conveying belt 8 and the discharge surfaces 1*a*, 1*b*, and 2*a* of the four inkjet heads 1 and the precoat head 2.

Further, the head lifting mechanism 33 can move up and down the frame 35*b* to move the inkjet head 1A for black between a first position (see FIG. 2A) and a second position (see FIG. 2B) where the gap between the sheet P placed on the conveying belt 8 and the inkjet head 1A is smaller than that in the state where the frame 35*b* is in the first position.

It is noted that the first position is set to prevent the discharge surface 1*a* of the inkjet head 1A from being contaminated with the precoat liquid. More specifically, in general, when a sheet with the precoat liquid attached thereto contacts an inkjet head, the discharge surface of the inkjet head might be contaminated with the precoat liquid, such that the inkjet head might not normally discharge ink droplets. Further, since a part of the precoat liquid discharged by a precoat head goes up above the sheet without attaching to the sheet, the discharge surface of the inkjet head might be contaminated with the part of the precoat liquid, such that the inkjet head might not normally discharge ink droplets. In order to resolve the above problems, the first position is set with a larger gap d1 between the sheet P placed on the conveying belt 8 and the discharge surface 1*a* of the inkjet head 1A, so as to prevent the discharge surface 1*a* from being contaminated with the precoat liquid.

Meanwhile, the second position is set with a smaller gap d2, than the gap d1, between the sheet P placed on the conveying belt 8 and the discharge surface 1*a* of the inkjet head 1A. Specifically, the gap d2 in the state where the frame 35*b* is in the second position is set such that the sheet P placed on the conveying belt 8 does not contact the discharge surface 1*a* of the inkjet head 1A.

Further, the head lifting mechanism 33 can move up and down the frame 35*c* to move the inkjet heads 1B for three colors other than black to the first position where the discharge surfaces 1*b* of the inkjet heads 1B faces the sheet P placed on the conveying belt 8 across the gap d1. Namely, the head lifting mechanism 33 can move the inkjet heads 1B to such a position as to prevent the discharge surface 1*b* of the inkjet head 1B from being contaminated with the precoat liquid.

Subsequently, referring to FIGS. 3 and 4, the controller 100 will be described. The controller 100 includes a CPU (Central Processing Unit), an EEPROM (Electrically Erasable and Programmable Read Only Memory) configured to store in a rewritable manner programs to be executed by the CPU and data to be used for the programs, and a RAM (Random Access Memory) configured to temporarily store the data during execution of the programs. Each functional unit included in the controller 100 is established by cooperation between the aforementioned hardware and the software stored in the EEPROM. As depicted in FIG. 3, the controller 100 controls the whole inkjet printer 101, and includes an image data storage unit 130, a liquid amount determining unit 131, a quality level storage unit 132, a printing mode determining unit 133, an execution mode determining unit 134, a feed tray storage unit 135, a feed controller 136, an image data changing unit 137, a gap controller 138, and head controller 139.

Further, the controller 100 is configured to perform execution modes, i.e., a first mode, a second mode, and a third mode. The first mode is an execution mode where the controller 100 controls the head lifting mechanism 33 to place the inkjet heads 1A and 1B in the first position (see FIG. 2A), controls the inkjet heads 1 to discharge at least black ink droplets from the discharge holes of the inkjet head 1A, and controls the precoat head 2 to discharge the precoat liquid from the discharge holes of the precoat head 2. The first mode, in which the precoat liquid is used for image formation, is such an execution mode as to form on the sheet P an image with a higher level of image quality in comparison with the second and third modes where the precoat liquid is not used for image formation.

The second mode is an execution mode where the controller 100 controls the head lifting mechanism 33 to place the inkjet head 1A for black and the inkjet heads 1B for the other colors in the second position and the first position, respectively (see FIG. 2B), controls the inkjet heads 1 to discharge black ink droplets from the discharge holes of the inkjet head 1A but not discharge any color ink droplets from the discharge holes of the inkjet heads 1B, and controls the precoat head 2 not to discharge, any precoat liquid droplet from the discharge holes of the precoat head 2. The second mode, in which the precoat liquid is not used, provides a somewhat lower level of image quality in comparison with the first mode. However, it is possible to improve the accuracy of a position of an ink droplet discharged from each discharge hole of the inkjet head 1A relative to the sheet P in comparison with the case where the inkjet head 1A is in the first position. Thus, the second mode is an execution mode to form on the sheet P a monochrome image with a high level of image quality.

In the second mode, only the inkjet head 1A for black is located in the second position. This is because when the inkjet heads 1B are as well located in the second position, it leads to a higher risk that a paper jam might occur. Specifically, immediately after ink is discharged by an inkjet head and applied on a sheet, the sheet might be curled under an influence of the ink applied thereon. Hence, when an inkjet head disposed downstream relative to a given inkjet head in the feeding direction is placed in the second position, the sheet curled under an influence of ink discharged by the upstream-side inkjet head might contact the downstream-side inkjet head, and thereby a paper jam might be caused. In the embodiment, to reduce the risk of a paper jam as much as possible and enhance image quality of characters that are usually printed with black ink, only the inkjet head 1A for black is placed in the second position, as described above.

The third mode is an execution mode where the controller controls the head lifting mechanism 33 to place the inkjet heads 1A and 1B in the first position (see FIG. 2A), controls the inkjet heads 1 to discharge at least black ink droplets from the discharge holes of the inkjet head 1A, and controls the precoat head 2 not to discharge any precoat liquid droplet from the discharge holes of the precoat head 2. The third mode provides a lower level of image quality of the image formed on the sheet P than the first and second modes.

The image data storage unit 130 is configured to store image data for the image to be formed on the sheet P. The image data includes respective density values of black ink, cyan ink, magenta ink, yellow ink, and the precoat liquid, for each of a plurality of pixels (unit areas) corresponding to an image resolution, which pixels are elements into which the sheet P is sectioned along the feeding direction and the main scanning direction (perpendicular to the feeding direction). Each density value is quantized into four values, i.e., "no discharge," "small-sized droplet," "middle-sized droplet," and "large-sized droplet."

The liquid amount determining unit 131 is configured to, when a remaining amount of the precoat liquid stored in the precoat liquid tank 20*c* is less than a predetermined amount, determine that there is not enough precoat liquid left. Meanwhile, when the remaining amount of the precoat liquid stored in the precoat liquid tank 20*c* is equal to or more than the predetermined amount, the liquid amount determining unit 131 determines that there is some precoat liquid left. Here, the predetermined amount denotes a remaining amount of the precoat liquid stored in the precoat liquid tank 20*c* at the time when the precoat head 2 is transferred from a state where the precoat head 2 is able to discharge the precoat liquid to a state where the precoat head 2 is not able to discharge the precoat liquid due to shortage of the precoat liquid left. Further, when determining that there is some precoat liquid left, the liquid amount determining unit 131 calculates an amount of the precoat liquid required for forming the image on the sheet P based on the image data stored in the image data storage unit 130, prior to forming the image. Then, when determining, based on a currently stored amount of the precoat liquid detected by the remaining precoat liquid amount detector 51, that an amount resulting from subtracting the calculated amount from the currently stored amount of the precoat liquid is equal to or more than the aforementioned predetermined amount, the liquid amount determining unit 131 determines that the precoat liquid will be left until completion of image formation (printing). Meanwhile, when determining that the amount obtained by subtracting the calculated amount from the currently stored amount of the precoat liquid is less than the aforementioned predetermined amount, the liquid amount determining unit 131 determines that the precoat liquid will be exhausted in the middle of image formation (printing).

Further, the liquid amount determining unit 131 calculates an amount of the ink required for forming the image on the sheet P based on the image data stored in the image data storage unit 130, prior to forming the image. Then, when determining, based on a currently stored amount of the ink detected by the remaining ink amount detector 50, that an amount obtained by subtracting the calculated amount from the currently stored amount of the ink is less than the aforementioned predetermined amount, the liquid amount determining unit 131 determines that the ink does not sufficiently remain, and sends to a superordinate PC the information that the ink does not sufficiently remain.

The quality level storage unit 132 stores one of quality levels with respect to the image quality of the image to be formed on the sheet P. In the embodiment, the quality level storage unit 132 stores one of three quality levels, i.e., a high image quality level, a middle image quality level, and a low image quality level. It is noted that the quality level stored in the quality level storage unit 132 is updated based on print data transferred from the superordinate PC.

The printing mode determining unit 133 determines which mode, of a color printing mode and a monochrome printing mode, is to be carried out, based on the image data stored in the image data storage unit 130. It is noted that in the color printing mode, color printing is performed with ink droplets discharged by the four inkjet heads 1A and 1B. In the monochrome printing mode, monochrome printing is performed with ink droplets discharged only by the inkjet head 1A for black.

The execution mode determining unit 134 determines an execution mode to be executed by the controller 100 from the first mode, the second mode, and the third mode. In the embodiment, as shown in FIG. 4, the execution mode determining unit 134 determines the first mode as the execution mode when the liquid amount determining unit 131 determines that the precoat liquid will be left until completion of image formation.

Further, the execution mode determining unit 134 determines the second mode as the execution mode when the liquid amount determining unit 131 determines that there is not enough precoat liquid left or that the precoat liquid will be exhausted in the middle of image formation, the printing mode determining unit 133 determines the monochrome printing mode to be carried out, and the quality level storage unit 132 stores the high image quality level.

Further, the execution mode determining unit 134 determines the third mode as the execution mode when the liquid amount determining unit 131 determines that there is not enough precoat liquid left or that the precoat liquid will be exhausted in the middle of image formation, the printing mode determining unit 133 determines the color printing mode, and the quality level storage unit 132 stores the middle image quality level or the low image quality level. Namely, the execution mode determining unit 134 determines the third mode as the execution mode except for cases where the execution mode determining unit 134 determines either the first mode or the second mode as the execution mode.

The feed tray storage unit 135 stores information regarding a tray from which the sheet P is to be fed to feeding mechanism 16. Specifically, the feed tray storage unit 135 stores one of information that represents the feed tray 11 and information that represents the manual feed tray 37. The information regarding the tray stored in the feed tray storage unit 135 is updated based on the print data transferred from the superordinate PC.

The feed controller 136 controls the sheet pickup unit 101*b*, the feed rollers 14 and 28, the manual-feed-tray feed roller 36, and the feeding mechanism 16. When the feed tray storage unit 135 stores the information that represents the feed tray 11, the feeding controller 136 controls the sheet pickup unit 101*b* to feed a top one of the sheets P placed in the feed tray 11 toward the feeding mechanism 16. Meanwhile, when the feed tray storage unit 135 stores the information that represents the manual feed tray 37, the feeding controller 136 controls the manual-feed-tray feed roller 36 to feed a top one of the sheets P placed on the manual feed tray 37 toward the feeding mechanism 16.

Further, when the execution mode determining unit 134 determines the second mode as the execution mode (namely, when the controller 100 carries out the second mode), the feed controller 136 controls the feeding mechanism 16 such that a feeding velocity at which the conveying belt 8 feeds the sheet P is lower than that in the case where the first mode is carried out. Thereby, it is possible to prevent the sheet P from floating up while being conveyed, and thus to prevent the sheet P from contacting the inkjet head 1A while being conveyed. Consequently, it is possible to avoid a paper jam.

The image data changing unit 137 changes the image data stored in the image data storage unit 130, based on the quality level stored in the quality level storage unit 132. Further, the image data changing unit 137 changes the image data stored in the image data storage unit 130 into appropriate image data depending on the execution mode determined by the execution mode determining unit 134. Hereinafter, a specific explanation will be provided about the aforementioned operation of the image data changing unit 137.

In general, to avoid curling of the sheet P and bleedthrough of ink, a total amount of liquid applicable onto each unit area of the sheet P has been determined. Accordingly, in the first mode, since the precoat liquid is discharged by the precoat head 2 and applied onto the sheet P, the maximum amount of ink applicable onto each unit area of the sheet P is defined as an amount resulting from subtracting the amount of the precoat liquid applied onto each unit area from the aforementioned total amount of liquid applicable onto each unit area. Meanwhile, in the second mode, since the precoat liquid is not discharged by the precoat head 2, the maximum amount of ink applicable onto each unit area of the sheet P is defined as the aforementioned total amount of liquid applicable onto each unit area. In the embodiment, the execution mode determining unit 134 determines the second mode as the execution mode, the image data changing unit 137 changes the image data stored in the image data storage unit 130 such that an amount of black ink to be discharged by the discharge holes of the inkjet head 1A is more than that in the first mode. In other words, the image data changing unit 137 changes the image data such that the size of black ink droplets to be discharged by the inkjet head 1A becomes larger. Thereby, it is possible to enhance the color optical density of the ink applied onto the sheet P, and to have an image of high image quality formed on the sheet P. In general, use of the precoat liquid improves the color optical density of the ink, and therefore there is a concern that the color optical density of the ink might be deteriorated in the second mode. However, according to the aforementioned configuration, it is possible to prevent the color optical density of the ink from being deteriorated in the second mode.

Further, when the execution mode determining unit 134 determines the second mode as the execution mode, as described above, the feeding velocity at which the conveying belt 8 feeds the sheet P is controlled by the feed controller 136 to be lower than that in the first mode. The image data changing unit 137 can change the image data stored in the image data storage unit 130 to enhance the image resolution to an extent possible under the maximum data transmission speed determined by the hardware configuration. For example, in the second mode, image formation is performed with the feeding velocity set to be half as high as that in the first mode and the image resolution in the auxiliary scanning direction changed from 1200 dpi to 600 dpi. Further, the image quality may be improved by changing a data processing method such as an error diffusion processing method and an edge processing method to a more highly accurate one, without changing the image resolution.

The gap controller 138 controls the head lifting mechanism 33 based on the execution mode determined by the execution mode determining unit 134. Specifically, when the execution mode determining unit 134 determines the first mode or the third mode as the execution mode, the gap controller 138 the head lifting mechanism 33 to place the inkjet heads 1A and 1B in the first position (see FIG. 2A). In other words, when an execution mode other than the second mode is carried out, the gap controller 138 controls the head lifting mechanism 33 to place the inkjet heads 1A and 1B in the first position. Further, when the execution mode determining unit 134 determines the second mode as the execution mode, the gap controller 138 controls the head lifting mechanism 33 to place the inkjet head 1A for black in the second position and place the inkjet heads 1B for the other colors in the first position (see FIG. 2B).

The head controller 139 controls the inkjet heads 1 and the precoat head 2 based on the image data stored in the image data storage unit 130 and the execution mode determined by the execution mode determining unit 134. Specifically, when the execution mode determining unit 134 determines the first mode as the execution mode, the head controller 139 controls the precoat head 2 to discharge a predetermined volume of precoat liquid droplet at a predetermined moment from each discharge hole, and controls each inkjet head 1 to discharge a predetermined volume of ink droplet at a predetermined moment from each discharge hole.

Further, when the execution mode determining unit 134 determines the second mode or the third mode as the execution mode, the head controller 139 controls the precoat head 2 not to discharge any precoat liquid droplet and controls each inkjet head 1 to discharge a predetermined volume of ink droplet at a predetermined moment from each discharge hole. In addition, when the printing mode determining unit 133 determines that the monochrome printing mode is to be carried out, the head controller 139 controls the inkjet heads 1 such that only the inkjet head 1A discharges ink droplets. When the printing mode determining unit 133 determines that the color printing mode is to be carried out, the head controller 139 controls the inkjet heads 1 such that each of the inkjet heads 1A and 1B discharges ink droplets.

Subsequently, an explanation will be provided about a printing operation to be executed by the controller 100 of the inkjet printer 101. As shown in FIG. 5, the controller 100 receives, from the superordinate PC, print data that contains the image data, the information representing the feed tray, and the quality level (51). At that time, the image data contained in the print data is stored into the image data storage unit 130. Further, the information representing the feed tray, contained in the print data, is stored into the feed tray storage unit 135. Furthermore, the quality level contained in the print data is stored into the quality level storage unit 132.

Next, when the liquid amount determining unit 131 determines that there is not enough ink left (the ink is exhausted) (S2: Yes), the controller 100 sends to the PC information that the ink is exhausted, and terminates the printing operation. Meanwhile, when the liquid amount determining unit 131 does not determine that there is not enough ink left (the ink is exhausted) (S2: No), the execution mode determining unit 134 determines an execution mode to be carried out from among the first to third modes, based on the determination made by the liquid amount determining unit 131, the determination made by the printing mode determining unit 133, and the quality level stored in the quality level storage unit 132 (S3).

When the execution mode determining unit 134 determines one of the first and third modes (other than the second mode) as the execution mode (S4: No), the gap controller 138 controls the head lifting mechanism 33 to place the four inkjet heads 1 in the first position as illustrated in FIG. 2A (S5). Thereafter, the controller 100 advances to S6.

In S6, when the printing mode determining unit 133 determines that the monochrome printing mode is not to be carried out (i.e., determines that the color printing mode is to be carried out) (S6: No), the controller 100 goes to S7. Meanwhile, when the printing mode determining unit 133 determines that the monochrome printing mode is to be carried out (S6: Yes), the controller 100 goes to S8.

In S7, the feed controller 136 controls the sheet pickup unit 101*b*, the feed rollers 14 and 28, the manual-feed-tray feed roller 36, and the feeding mechanism 16, such that the sheet P is conveyed in the feeding direction. At this time, the head controller 139 controls each of the inkjet heads 1A and 1B to discharge a predetermined volume of ink droplet at a predetermined moment from each discharge hole, based on the image data stored in the image data storage unit 130. Further, when the execution mode determining unit 134 determines the first mode as the execution mode, the head controller 139 controls the precoat head 2 to discharge a predetermined volume of precoat liquid droplet at a predetermined moment from each discharge hole. Consequently, a color image of a high level of image quality onto which the precoat liquid is applied is formed on the sheet P. Meanwhile, when the execution mode determining unit 134 determines the third mode as the execution mode, the head controller 139 controls the precoat head 2 not to discharge any precoat liquid droplet from the discharge holes of the precoat head 2. Thus, a color image with no precoat liquid applied thereon is formed on the sheet P.

In S8, the feed controller 136 controls the sheet pickup unit 101*b*, the feed rollers 14 and 28, the manual-feed-tray feed roller 36, and the feeding mechanism 16, such that the sheet P is conveyed in the feeding direction. At this time, the head controller 139 controls the inkjet heads 1 to discharge a predetermined volume of ink droplet at a predetermined moment only from the inkjet head 1A, based on the image data stored in the image data storage unit 130. Further, when the execution mode determining unit 134 determines the first mode as the execution mode, the head controller 139 controls the precoat head 2 to discharge a predetermined volume of precoat liquid droplet at a predetermined moment from each discharge hole. Consequently, a monochrome image of a high level of image quality onto which the precoat liquid is applied is formed on the sheet P. Meanwhile, when the execution mode determining unit 134 determines the third mode as the execution mode, the head controller 139 controls the precoat head 2 not to discharge any precoat liquid droplet from the discharge holes of the precoat head 2. Thus, a monochrome image with no precoat liquid applied thereon is formed on the sheet P.

Meanwhile, when the execution mode determining unit 134 determines the second mode as the execution mode (S4: Yes), the gap controller 138 controls the head lifting mechanism 33 to place the inkjet head 1A for black in the second position and place the inkjet heads 1B for the other three colors in the first position, as illustrated in FIG. 2B (S9).

Subsequently, the image data changing unit 137 changes the image data stored in the image data storage unit 130 into appropriate image data depending on the second mode (S10). Thereafter, the controller 100 advances to S11.

In S10, the feed controller 136 controls the sheet pickup unit 101*b*, the feed rollers 14 and 28, the manual-feed-tray feed roller 36, and the feeding mechanism 16, such that the sheet P is conveyed in the feeding direction. It is noted that the feeding velocity at which the conveying belt 8 conveys the sheet P is rendered lower in comparison with the case where the first mode is carried out. At this time, the head controller 139 controls the inkjet heads 1 to discharge a predetermined volume of ink droplet at a predetermined moment only from the inkjet head 1A, based on the image data stored in the image data storage unit 130. Further, the head controller 139 controls the precoat head 2 not to discharge any precoat liquid droplet from the discharge holes of the precoat head 2.

Thereby, a monochrome image with no precoat liquid applied thereon is formed on the sheet P. Hereinabove, the printing operation by the controller 100 of the inkjet printer 101 has been described.

According to the embodiment, when the remaining amount of the precoat liquid stored in the precoat liquid tank 20*c* is less than the predetermined amount, and the quality level stored in the quality level storage unit 132 is the high image quality level, the inkjet head 1A is located in the second position where the gap between the inkjet head 1A and the sheet P is smaller. Therefore, it is possible to improve the accuracy of a landing position of an ink droplet discharged from each discharge hole of the inkjet head 1A relative to the sheet P. Consequently, even without use of the precoat liquid, it is possible to prevent the image quality of the image formed on the sheet P from being deteriorated and to maintain a desired level of image quality.

Further, according to the embodiment, when the remaining amount of the precoat liquid stored in the precoat liquid tank 20*c* is estimated to be less than the predetermined amount in the middle of image formation, the second mode is carried out from the beginning of image formation. Therefore, it is possible to form the image on the sheet P with a constant level of image quality maintained throughout image formation.

Further, according to the embodiment, when the second mode is carried out, the feeding velocity for feeding the sheet P is rendered lower than that in the first mode. Thereby, it is possible to prevent the sheet P from floating up while being conveyed. Consequently, even when the controller 100 carries out the second mode where the gap between the discharge holes of the inkjet head 1A and the sheet P is smaller than that in the first mode, it is possible to prevent the sheet P from contacting the inkjet head 1A while being conveyed, and thus to avoid a paper jam.

Further, according to the embodiment, when the second mode is carried out, a larger amount of ink is applied onto each unit area of the sheet P. Thereby, it is possible to enhance the color optical density of the ink on the sheet P, and to restrain deterioration of the color optical density of the ink on the sheet P even without use of the precoat liquid.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

<Modifications>

In the aforementioned embodiment, when the remaining amount of the precoat liquid stored in the precoat liquid tank 20*c* is estimated to be less than the predetermined amount in the middle of image formation, the controller 100 carries out the second mode from the beginning of the image formation. However, the controller 100 may carry out the first mode until the remaining amount of the precoat liquid stored in the precoat liquid tank 20*c* becomes less than the predetermined amount, and thereafter carry out the second mode in the middle of image formation.

Further, when the remaining amount of the precoat liquid stored in the precoat liquid tank 20*c* is estimated to be less than the predetermined amount in the middle of image formation, the controller 100 may send to the superordinate PC a signal for asking the user whether to carry out the second mode from the beginning of image formation or in the middle of image formation after carrying out the first mode until the remaining amount of the precoat liquid stored in the precoat liquid tank 20*c* becomes less than the predetermined amount. Thereby, it is possible to allow the user to select one of the two methods, i.e., one method to form an image with a higher level of image quality while discharging the precoat liquid until the remaining amount of the precoat liquid stored in the precoat liquid tank 20*c* becomes less than the predetermined amount and thereafter form an image with lower level of image quality without any precoat liquid discharged, and the other method to form an image with a lower but constant level of image quality throughout image formation. In addition, when the aforementioned signal is sent to the superordinate PC, information may be added to the signal, which information enables the user to be aware of such a moment (or a position on a sheet) that the remaining amount of the precoat liquid stored in the precoat liquid tank 20*c* becomes less than the predetermined amount.

One of factors that cause the execution mode determining unit 134 to determine the second mode as the execution mode may be that the information representing the feed tray 11 is stored in the feed tray storage unit 135. Namely, the execution mode determining unit 134 may determine the second mode as the execution mode, when the liquid amount determining unit 131 determines that there is not enough precoat liquid left or that the precoat liquid will be exhausted in the middle of image formation, the printing mode determining unit 133 determines the monochrome printing mode to be carried out, the quality level storage unit 132 stores the high image quality level, and the feed tray storage unit 135 stores the information representing the feed tray 11. Sheets placed on the manual feed tray 37, such as post cards or envelopes, are thick. Hence, when the inkjet head 1A is located in the second position, the sheet P fed from the manual feed tray 37 might contact the inkjet head 1A. Then, as described above, when the execution mode determining unit 134 is configured not to determine the second mode as the execution mode in the state where the feed tray storage unit 135 stores the information representing the manual feed tray 37, it is possible to avoid contact between the inkjet head 1A and the sheet P fed from the manual feed tray 37.

Further, the controller 100 may be configured to carry out, as the execution mode, a fourth mode to place the inkjet heads 1A and 1B in a third position between the first position and the second position, control the inkjet heads 1 to discharge ink droplets from each discharge hole of the inkjet heads 1A and 1B, and control the precoat head 2 not to discharge any precoat liquid droplet from the discharge holes of the precoat head 2. It is noted that when the third position is such a position that a gap is formed between the discharge surfaces of the inkjet heads 1 placed there and the (uncurled) sheet P placed on the conveying belt 8, to such an extent that even if the sheet P is curled under an influence of the ink discharged by an inkjet head disposed upstream in the feeding direction, the curled sheet P does not contact the discharge surface of an inkjet head disposed downstream in the feeding direction. In the fourth mode, the image quality of the image formed on the sheet P is lower than that in the first mode. However, it is possible to improve the accuracy of a landing position of an ink droplet discharged from each discharge hole of the inkjet heads 1A and 1B relative to the sheet P, in comparison with the state where the inkjet heads 1A and 1B are located in the first position. Thus, it is possible to form a color image with a higher level of image quality than that in the third mode.

In the aforementioned embodiment, the predetermined amount with respect to the remaining amount of the precoat liquid stored in the precoat liquid tank 20*c* denotes the remaining amount of the precoat liquid stored in the precoat liquid tank 20*c* at the time when the precoat head 2 is transferred from the state where the precoat head 2 can discharge the precoat liquid to the state where the precoat head 2 cannot discharge the precoat liquid due to shortage of the precoat liquid left. However, the predetermined amount is not limited to the above definition, but may be defined as needed in a different manner. For instance, the predetermined amount may be defined as 10% of the capacity of the precoat liquid tank 20*c*, in consideration of an estimated amount of the precoat liquid that may be used for maintenance (e.g., purge) of the precoat head 2 until replacement of the precoat liquid tank 20*c*.

In the aforementioned embodiment, in the second mode, the controller 100 controls the head lifting mechanism 33 to place the inkjet head 1A for black in the second position and place the inkjet heads 1B for the other three colors in the first position. However, in order to perform color printing, the controller 100 may control the head lifting mechanism 33 to place the inkjet heads 1A and 1B in the second position.

In the aforementioned embodiment, the execution mode determining unit 134 determines the second mode as the execution mode when the liquid amount determining unit 131 determines that there is not enough precoat liquid left or that the precoat liquid will be exhausted in the middle of image formation, and the quality level storage unit 132 stores the high image quality level. However, the execution mode determining unit 134 may be configured to, when the liquid amount determining unit 131 determines that there is not enough precoat liquid left or that the precoat liquid will be exhausted in the middle of image formation, inquire of the user whether to change the quality level from the high image quality level to one of the middle image quality level and the low image quality level. Additionally, the execution mode determining unit 134 may be configured to, when the user issues an instruction not to change the quality level, determine the second mode as the execution mode. In this case, the execution mode determining unit 134 may determine the execution mode after waiting until the user issues an instruction as to whether to change the quality level.

In the aforementioned embodiment, the inkjet printer 101 includes the inkjet head 1A for black and the inkjet heads 1B for cyan (C), magenta (M), and yellow (Y). However, as shown in FIG. 6, the inkjet printer 101 may be configured without the inkjet heads 1B.

In the aforementioned embodiment, the feeding mechanism 16 includes the two belt rollers 6 and 7, the conveying belt 8, the tension roller 10, and the platen 18. However, as shown in FIG. 6, the feeding mechanism 16 may include a plurality of spur rollers 38 configured to convey the sheet P, instead of the conveying belt 8.

In the aforementioned embodiment, the precoat liquid, discharged by the precoat head 2, is applied onto the sheet P being conveyed on the conveying belt 8. However, as illustrated in FIG. 7, the precoat liquid may be applied onto the sheet P by a roller 110 instead of the precoat head 2. Specifically, as shown in FIG. 7, the inkjet printer 101 may include a precoat liquid applicator configured to apply the precoat liquid onto the sheet P. The precoat liquid applicator may include the roller 110 and a precoat liquid supply mechanism 120 configured to supply the precoat liquid stored in a precoat liquid tank 20*c* to an outer circumferential surface of the roller 110. It is noted that remaining portions, of the inkjet printer 101 shown in FIG. 7, other than the precoat liquid applicator may be configured in the same manner as exemplified in the aforementioned embodiment. Further, in the inkjet printer 101 shown in FIG. 7, the controller 100 may include the execution mode determining unit 134 configured to determine an execution mode to be executed from the first to third modes, in the same manner as exemplified in the aforementioned embodiment. According to the inkjet printer 101 shown in FIG. 7, when applied by the roller 110 of the precoat liquid applicator, the precoat liquid is attached evenly onto a whole recording area of the sheet P.

Aspects of the present invention may be applied to a liquid discharger configured to discharge liquid other than ink. In addition, aspects of the present invention may be applied to not only a printer but also a facsimile machine or a copy machine. Further, the influences of the precoat liquid on the ink may include agglutinating or precipitating one or more components (such as pigment and dye) contained in the ink in a chemical reaction caused as a result of the processing liquid mixing with the ink. Furthermore, the influences of the precoat liquid on the ink may include agglutinating or precipitating one or more components contained in the ink without any chemical reaction between the precoat liquid and the ink. As described in the aforementioned embodiment, in general, precoat liquid for agglutinating a pigment coloring component is applied to pigment ink, and precoat liquid for precipitating a dye coloring component is applied to dye ink. However, precoat liquid may be employed that has both functions of agglutinating and precipitating a coloring component contained in ink.

What is claimed is:

1. A liquid discharger comprising:

a feeding mechanism configured to feed a sheet in a predetermined feeding direction;

a first liquid tank configured to store first liquid for forming an image on the sheet;

a first liquid discharge head comprising a first discharge hole formed to discharge the first liquid stored in the first liquid tank;

a second liquid tank configured to store second liquid that acts on the first liquid so as to agglutinate or precipitate a component contained in the first liquid;

a second liquid discharge head comprising a second discharge hole formed to discharge the second liquid stored in the second liquid tank, the second liquid discharge head being disposed upstream relative to the first liquid discharge head in the predetermined feeding direction;

a remaining second-liquid amount detector configured to detect a remaining amount of the second liquid stored in the second liquid tank;

a gap adjustor configured to adjust a gap between the first discharge hole of the first liquid discharge head and the sheet facing the first discharge hole, by moving the first liquid discharge head between a first position and a second position where the gap is smaller than when the first liquid discharge head is in the first position;

a storage unit configured to store one of a plurality of quality levels regarding image quality of the image to be formed on the sheet; and a controller configured to control the first liquid discharge head, the second liquid discharge head, the feeding mechanism, and the gap adjustor so as to form the image on the sheet based on image data, wherein the controller is configured to carry out a plurality of execution modes comprising a first mode and a second mode, in the first mode, the controller controls the gap adjustor to place the first liquid discharge head in the first position, controls the first liquid discharge head to discharge the first liquid from the first discharge hole, and controls the second liquid discharge head to discharge the second liquid from the second discharge hole, in the second mode, the controller controls the gap adjustor to place the first liquid discharge head in the second position, controls the first liquid discharge head to discharge the first liquid from the first discharge hole, and forbids the second liquid discharge head to discharge the second liquid from the second discharge hole, when determining that the second liquid stored in the second liquid tank is left enough to form the image based on the remaining amount of the second liquid detected by the remaining second-liquid amount detector, the controller carries out the first mode, and when determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

2. The liquid discharger according to claim 1, wherein when carrying out an execution mode other than the second mode, the controller controls the gap adjustor to place the first liquid discharge head in the first position.

3. The liquid discharger according to claim 1, wherein prior to forming the image on the sheet based on the image data, the controller calculates an amount of the second liquid required for forming the image, based on the image data, and when determining that an amount resulting from subtracting the calculated amount of the second liquid from the remaining amount of the second liquid detected by the remaining second-liquid amount detector is less than a predetermined amount and that the quality level stored in the storage unit is equal to or more than the predetermined level, the controller carries out the second mode from the beginning of image formation.

4. The liquid discharger according to claim 1, wherein when carrying out the second mode, the controller controls the feeding mechanism to feed the sheet at a lower feeding velocity than when carrying out the first mode.

5. The liquid discharger according to claim 1, wherein when carrying out the second mode, the controller controls the first liquid discharge head to discharge, from the first discharge hole, a larger amount of the first liquid onto each unit area of the sheet than when carrying out the first mode.

6. An image forming apparatus comprising:

a feeding mechanism configured to feed a sheet in a predetermined feeding direction;

a liquid discharger configured to discharge a plurality of sorts of liquid onto the sheet fed by the feeding mechanism to form an image on the sheet;

a controller configured to control the feeding mechanism and the liquid discharger to form the image on the sheet based on image data, wherein the liquid discharger comprises:

a first liquid tank configured to store first liquid for forming the image on the sheet;

a first liquid discharge head comprising a first discharge hole formed to discharge the first liquid stored in the first liquid tank;

a second liquid tank configured to store second liquid that acts on the first liquid so as to agglutinate or precipitate a component contained in the first liquid;

a second liquid discharge head comprising a second discharge hole formed to discharge the second liquid stored in the second liquid tank, the second liquid discharge head being disposed upstream relative to the first liquid discharge head in the predetermined feeding direction;

a remaining second-liquid amount detector configured to detect a remaining amount of the second liquid stored in the second liquid tank;

a gap adjustor configured to adjust a gap between the first discharge hole of the first liquid discharge head and the sheet facing the first discharge hole, by moving the first liquid discharge head between a first position and a second position where the gap is smaller than when the first liquid discharge head is in the first position; and a storage unit configured to store one of a plurality of quality levels regarding image quality of the image to be formed on the sheet, wherein the controller is configured to carry out a plurality of execution modes comprising a first mode and a second mode, wherein in the first mode, the controller controls the gap adjustor to place the first liquid discharge head in the first position, controls the first liquid discharge head to discharge the first liquid from the first discharge hole, and controls the second liquid discharge head to discharge the second liquid from the second discharge hole, wherein in the second mode, the controller controls the gap adjustor to place the first liquid discharge head in the second position, controls the first liquid discharge head to discharge the first liquid from the first discharge hole, and forbids the second liquid discharge head to discharge the second liquid from the second discharge hole, wherein when determining that the second liquid stored in the second liquid tank is left enough to form the image based on the remaining amount of the second liquid detected by the remaining second-liquid amount detector, the controller carries out the first mode, and wherein when determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

7. The image forming apparatus according to claim 6, wherein when carrying out an execution mode other than the second mode, the controller controls the gap adjustor to place the first liquid discharge head in the first position.

8. The image forming apparatus according to claim 6, wherein prior to forming the image on the sheet based on the image data, the controller calculates an amount of the second liquid required for forming the image, based on the image data, and when determining that an amount resulting from subtracting the calculated amount of the second liquid from the remaining amount of the second liquid detected by the remaining second-liquid amount detector is less than a predetermined amount and that the quality level stored in the storage unit is equal to or more than the predetermined level, the controller carries out the second mode from the beginning of image formation.

9. The image forming apparatus according to claim 6, wherein when carrying out the second mode, the controller controls the feeding mechanism to feed the sheet at a lower feeding velocity than when carrying out the first mode.

10. The image forming apparatus according to claim 6, wherein when carrying out the second mode, the controller controls the first liquid discharge head to discharge, from the first discharge hole, a larger amount of the first liquid onto each unit area of the sheet than when carrying out the first mode.

11. An image forming apparatus comprising:

a feeding mechanism configured to feed a sheet in a predetermined feeding direction;

a liquid discharger configured to discharge a plurality of sorts of liquid onto the sheet fed by the feeding mechanism to form an image on the sheet;

a controller configured to control the feeding mechanism and the liquid discharger to form the image on the sheet based on image data, wherein the liquid discharger comprises:

a first liquid tank unit configured to store a plurality of sorts of first liquid for forming the image on the sheet, the plurality of sorts of first liquid comprising black liquid and color liquid;

a first liquid discharge head that comprises a black liquid discharge head comprising a black discharge hole formed to discharge the black liquid stored in the first liquid tank unit and a color liquid discharge head comprising a color discharge hole formed to discharge the color liquid stored in the first liquid tank unit, the color liquid discharge head being disposed downstream relative to the black liquid discharge head in the predetermined feeding direction;

a second liquid tank configured to store second liquid that acts on the first liquid so as to agglutinate or precipitate a component contained in the first liquid;

a second liquid discharge head comprising a second discharge hole formed to discharge the second liquid stored in the second liquid tank, the second liquid discharge head being disposed upstream relative to the first liquid discharge head in the predetermined feeding direction;

a remaining second-liquid amount detector configured to detect a remaining amount of the second liquid stored in the second liquid tank;

a gap adjustor configured to adjust a gap between the black discharge hole of the black liquid discharge head and the sheet facing the first discharge hole, by moving the black liquid discharge head between a first position and a second position where the gap is smaller than when the black liquid discharge head is in the first position; and a storage unit configured to store one of a plurality of quality levels regarding image quality of the image to be formed on the sheet, wherein the controller is configured to carry out a plurality of execution modes comprising a first mode, a second mode, and a third mode, wherein in the first mode, the controller controls the gap adjustor to place the black liquid discharge head in the first position, controls the first liquid discharge head to discharge at least the black liquid from the black discharge hole, and controls the second liquid discharge head to discharge the second liquid from the second discharge hole, wherein in the second mode, the controller controls the gap adjustor to place the black liquid discharge head in the second position, controls the black liquid discharge head to discharge the black liquid from the black discharge hole, forbids the color liquid discharge head to discharge the color liquid from the color discharge hole, and forbids the second liquid discharge head to discharge the second liquid from the second discharge hole, wherein in the third mode, the controller controls the gap adjustor to place the black liquid discharge head in the first position, controls the first liquid discharge head to discharge at least the black liquid from the black discharge hole, and forbids the second liquid discharge head to discharge the second liquid from the second discharge hole, wherein when determining that the second liquid stored in the second liquid tank is left enough to form the image based on the remaining amount of the second liquid detected by the remaining second-liquid amount detector, the controller carries out the first mode, wherein when determining that the second liquid stored in the second liquid tank is not left enough to form the image based on the remaining amount of the second liquid detected by the remaining second-liquid amount detector, that monochrome printing is to be carried out, and that the quality level stored in the storage unit is equal to or more than a predetermined level, the controller carries out the second mode, and wherein when determining that the second liquid stored in the second liquid tank is not left enough to form the image based on the remaining amount of the second liquid detected by the remaining second-liquid amount detector and that the quality level stored in the storage unit is less than the predetermined level, the controller carries out the third mode.

12. The image forming apparatus according to claim 11, wherein prior to forming the image on the sheet based on the image data, the controller calculates an amount of the second liquid required for forming the image, based on the image data, and when determining that an amount resulting from subtracting the calculated amount of the second liquid from the remaining amount of the second liquid detected by the remaining second-liquid amount detector is less than a predetermined amount, that monochrome printing is to be carried out, and that the quality level stored in the storage unit is equal to or more than the predetermined level, the controller carries out the second mode from the beginning of image formation.

13. The image forming apparatus according to claim 11, wherein when carrying out the second mode, the controller controls the feeding mechanism to feed the sheet at a lower feeding velocity than when carrying out the first mode.

14. The image forming apparatus according to claim 11, wherein when carrying out the second mode, the controller controls the black liquid discharge head to discharge, from the black discharge hole, a larger amount of the black liquid onto each unit area of the sheet than when carrying out the first mode.

15. A liquid discharger comprising:

a feeding mechanism configured to feed a sheet in a predetermined feeding direction;

a first liquid tank configured to store first liquid for forming an image on the sheet;

a first-liquid discharge head comprising a first discharge hole formed to discharge the first liquid stored in the first liquid tank;

a second liquid tank configured to store second liquid that acts on the first liquid so as to agglutinate or precipitate a component contained in the first liquid;

a second-liquid applicator configured to apply the second liquid stored in the second liquid tank onto the sheet fed by the feeding mechanism prior to the first liquid being discharged onto the sheet by the first-liquid discharge head;

a remaining second-liquid amount detector configured to detect a remaining amount of the second liquid stored in the second liquid tank;

a gap adjustor configured to adjust a gap between the first discharge hole of the first-liquid discharge head and the sheet facing the first discharge hole, by moving the first-liquid discharge head between a first position and a second position where the gap is smaller than when the first-liquid discharge head is in the first position;

a storage unit configured to store one of a plurality of quality levels regarding image quality of the image to be formed on the sheet; and a controller configured to control the first-liquid discharge head, the second-liquid applicator, the feeding mechanism, and the gap adjustor so as to form the image on the sheet based on image data, wherein the controller is configured to carry out a plurality of execution modes comprising a first mode and a second mode, in the first mode, the controller controls the gap adjustor to place the first-liquid discharge head in the first position, controls the first-liquid discharge head to discharge the first liquid from the first discharge hole, and controls the second-liquid applicator to apply the second liquid onto the sheet, in the second mode, the controller controls the gap adjustor to place the first-liquid discharge head in the second position, controls the first-liquid discharge head to discharge the first liquid from the first discharge hole, and forbids the second-liquid applicator to apply the second liquid onto the sheet, when determining that the second liquid stored in the second liquid tank is left enough to form the image based on the remaining amount of the second liquid detected by the remaining second-liquid amount detector, the controller carries out the first mode, and when determining that the second liquid stored in the second liquid tank is not left enough to form the image based on the remaining amount of the second liquid detected by the remaining second-liquid amount detector and that the quality level stored in the storage unit is equal to or more than a predetermined level, the controller carries out the second mode.

* * * * *